US007093583B2

(12) United States Patent
Inoue et al.

(10) Patent No.: US 7,093,583 B2
(45) Date of Patent: Aug. 22, 2006

(54) HIGH-PRESSURE FUEL SUPPLY APPARATUS OF INTERNAL COMBUSTION ENGINE AND METHOD OF DESIGNING THE SAME

(75) Inventors: Yasumichi Inoue, Toyota (JP); Zenichiro Mashiki, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/229,373

(22) Filed: Sep. 19, 2005

(65) Prior Publication Data

US 2006/0065243 A1 Mar. 30, 2006

(30) Foreign Application Priority Data

Sep. 24, 2004 (JP) ..... 2004-277341

(51) Int. Cl.
*F02M 7/093* (2006.01)
*F02M 33/04* (2006.01)

(52) U.S. Cl. ..... 123/446; 123/495

(58) Field of Classification Search ..... 123/434, 123/446, 467, 479, 495, 506, 507, 508, 510, 123/514
See application file for complete search history.

(56) References Cited

U.S. PATENT DOCUMENTS 5,309,885 A * 5/1994 Rawlings et al. ..... 123/509
5,441,027 A * 8/1995 Buchanon et al. ..... 123/446
5,517,973 A 5/1996 Askew et al.
6,102,010 A * 8/2000 Isozumi et al. ..... 123/506
6,231,318 B1 * 5/2001 Cotton et al. ..... 417/423.1
6,314,945 B1 11/2001 Sugiyama et al.
6,860,255 B1 * 3/2005 Yamaguchi et al. ..... 123/495

FOREIGN PATENT DOCUMENTS

| | | |
|---|---|---|
| EP | 0 531 533 A1 | 3/1993 |
| EP | 1 072 781 A2 | 1/2001 |
| JP | A 2000-18068 | 1/2000 |
| JP | A 2001-41088 | 2/2001 |
| JP | A 2001-50095 | 2/2001 |
| JP | A 2003-301759 | 10/2003 |
| JP | A 2003-328812 | 11/2003 |

* cited by examiner

*Primary Examiner*—Tony M. Argenbright
*Assistant Examiner*—Johnny H. Hoang
(74) *Attorney, Agent, or Firm*—Oliff & Berridge, PLC

(57) ABSTRACT

A high-pressure fuel supply system is suitable for an internal combustion engine having an in-cylinder injector for injecting a fuel into a cylinder. The high-pressure fuel supply system includes a high-pressure fuel pump driven by an engine, a high-pressure delivery pipe supplying the fuel from the high-pressure fuel pump to the in-cylinder injector, and an actuation valve provided with a leakage function provided between the high-pressure fuel pump and the high-pressure delivery pipe. An amount of leakage in the actuation valve provided with the leakage function is set to an amount not smaller than a discharge amount of the high-pressure fuel pump.

5 Claims, 2 Drawing Sheets

HIGH-PRESSURE FUEL SUPPLY APPARATUS OF INTERNAL COMBUSTION ENGINE AND METHOD OF DESIGNING THE SAME

This nonprovisional application is based on Japanese Patent Application No. 2004-277341 filed with the Japan Patent Office on Sep. 24, 2004, the entire contents of which are hereby incorporated by reference.

BACKGROUND OF THE INVENTION

1. Field of the Invention

The present invention relates to a control device of a high-pressure fuel system of an internal combustion engine that includes a fuel injection mechanism (in-cylinder injector) for injecting a fuel into a cylinder at a high pressure, or an internal combustion engine that includes, in addition to the above fuel injection mechanism, a fuel injection mechanism (intake manifold injector) for injecting a fuel into an intake manifold or an intake port. More particularly, the present invention relates to a high-pressure fuel supply apparatus including a high-pressure fuel pump avoiding uncomfortable feeling caused by intermittent actuation sound, as well as to a method of designing such an apparatus.

2. Description of the Background Art

An engine having a first fuel injection valve (in-cylinder injector) for injecting a fuel into a combustion chamber of a gasoline engine and a second fuel injection valve (intake manifold injector) for injecting a fuel into an intake manifold, and changing a fuel injection ratio between the in-cylinder injector and the intake manifold injector in accordance with the engine speed or the load of the internal combustion engine is known. A direct injection engine having only a fuel injection valve (in-cylinder injector) for injecting a fuel into a combustion chamber of a gasoline engine is also known. In a high-pressure fuel system including the in-cylinder injector, the fuel having its pressure increased by a high-pressure fuel pump is supplied via a delivery pipe to the in-cylinder injector, which injects the high-pressure fuel into a combustion chamber of each cylinder of the internal combustion engine.

Further, a diesel engine having a common rail fuel injection system is also known. In the common rail fuel injection system, the fuel having its pressure increased by a high-pressure fuel pump is stored in a common rail, and injected from the common rail into a combustion chamber of each cylinder of the diesel engine according to opening/closing of an electromagnetic valve.

To obtain the fuel of a high pressure in such internal combustion engines, a high-pressure fuel pump is used which has a cylinder driven by a cam provided at a driveshaft that is connected to a crankshaft of the internal combustion engine.

Japanese Patent Laying-Open No. 2001-41088 discloses a control device for a fuel pump capable of lowering continuous actuation sound caused each time an electromagnetic spill valve is closed. The control device for a fuel pump includes a fuel pump varying a volume of a pressurizing chamber based on relative movement of a cylinder and a plunger as a result of rotation of a cam, so as to suction a fuel into the pressurizing chamber and delivering the fuel to a fuel injection valve of the internal combustion engine, and an electromagnetic spill valve opening and closing a spill path for flow-out of the fuel from the pressurizing chamber. According to the control device for a fuel pump, an amount of fuel delivery from the fuel pump to the fuel injection valve is regulated by controlling a valve closing duration of the electromagnetic spill valve. The control device for a fuel pump includes a control unit for controlling the electromagnetic spill valve based on an operation state of the internal combustion engine so as to adjust the number of times of fuel delivery by the fuel pump during a prescribed period, so that the number of times of fuel injection from the fuel injection valve per one fuel delivery is changed, i.e., the number of times of fuel injection per one fuel delivery is decreased while the engine is in a low load state.

According to this control device for a fuel pump, the number of times of fuel injection per one fuel delivery is decreased while the engine is in a low load state during which continuous actuation sound is relatively high. Therefore, an amount of fuel delivered in one fuel delivery can be small. Accordingly, valve closing start timing of the electromagnetic spill valve can further be closer to the top dead center, a cam speed at the time of closing of the electromagnetic spill valve can be slower, and a sound produced when the electromagnetic spill valve is closed can further be lowered. By lowering the sound produced when the electromagnetic spill valve is closed, continuous actuation sound caused each time the electromagnetic spill valve is closed is lowered.

Japanese Patent Laying-Open No. 2001-41088 described above, however, is directed solely to lowering of continuous actuation sound in a low load state such as idling.

In such a high-pressure fuel system, a check valve provided with a leakage function is provided in the electromagnetic spill valve closer to a high-pressure pipe side. The check valve provided with the leakage function is a check valve of a normal type but provided with pores that are always open. Accordingly, when a fuel pressure within the high-pressure fuel pump becomes lower than a fuel pressure within the high-pressure delivery pipe (for example, when the engine and hence the cam stops while the electromagnetic spill valve remains open), the high-pressure fuel within the high-pressure delivery pipe returns through the pores back to the high-pressure fuel pump side, thereby lowering the fuel pressure within the high-pressure delivery pipe. As such, at the time of stop of the engine, for example, the fuel within the high-pressure delivery pipe is not at a high pressure, so that leakage of the fuel from the in-cylinder injectors can be prevented.

Depending on an amount of leakage in the check valve provided with the leakage function, the high-pressure pump may intermittently operate. Namely, when the fuel pressure becomes too high, the fuel pressure is controlled in a feedback manner by a fuel pressure sensor provided at the high-pressure delivery pipe, drive duty of the electromagnetic spill valve is set to 0%, and the electromagnetic spill valve remains open. Though a pump plunger slides up and down as long as the cam continues to rotate (along with revolution of the engine), the electromagnetic spill valve does not close, in which case the fuel is not pressurized. Thereafter, when the fuel pressure becomes too low, the drive duty of the electromagnetic spill valve is no longer set to 0%, the electromagnetic spill valve closes, and the fuel is pressurized.

If an amount of leakage in the check valve provided with the leakage function structured as above is inappropriate, the high-pressure pump is intermittently actuated (a period during which actuation sound caused by a valve closing operation of the electromagnetic spill valve is not produced and a period during which the actuation sound is produced are repeated at certain intervals), irregular actuation sound is produced, and a driver or the like may feel uncomfortable. That is, as a result of intermittent actuation of the high-pressure pump, sound from the engine is changed, which results in uncomfortable feeling. In particular, such uncomfortable feeling is strongly felt outside a vehicle during idling.

SUMMARY OF THE INVENTION

The present invention was made to solve the above-described problems. An object of the present invention is to provide a high-pressure fuel supply apparatus of an internal combustion engine without causing uncomfortable feeling by avoiding intermittent actuation of the high-pressure pump for producing constant actuation sound.

A high-pressure fuel supply apparatus according to one aspect of the present invention is suitable for an internal combustion engine having a fuel injection mechanism for injecting a fuel into a cylinder. The high-pressure fuel supply apparatus includes: a high-pressure fuel pump driven by the internal combustion engine; a high-pressure pipe supplying the fuel from the high-pressure fuel pump to the fuel injection mechanism; and an actuation valve provided with a leakage function provided between the high-pressure fuel pump and the high-pressure pipe. An amount of leakage per a unit time in the actuation valve provided with the leakage function is set to an amount equal to or larger than a discharge amount per a unit time calculated by using a minimum discharge amount in the high-pressure fuel pump.

According to the present invention, an amount of leakage per a unit time (per one second) in the actuation valve provided with the leakage function is designed to an amount equal to or larger than a discharge amount per a unit time (per one second) calculated by using a minimum discharge amount in the high-pressure fuel pump. Accordingly, the discharge amount in the high-pressure fuel pump does not exceed the leakage amount and the fuel pressure does not become too high. Therefore, stop of actuation of the high-pressure fuel pump which results in lowering in the fuel pressure and subsequent resumption of actuation of the same is no longer repeated. Consequently, a high-pressure fuel supply apparatus of an internal combustion engine capable of preventing a driver or the like from feeling uncomfortable as a result of irregular actuation sound can be provided.

Preferably, the actuation valve is a check valve.

According to the present invention, by designing an amount of leakage per a unit time (per one second) in the actuation valve provided with the leakage function to be equal to or larger than a discharge amount per a unit time (per one second) in the high-pressure fuel pump, repetition of resumption of actuation of the high-pressure fuel pump can be avoided.

A designing method according to another aspect of the present invention is directed to a method of designing a high-pressure fuel supply apparatus of an internal combustion engine having a fuel injection mechanism for injecting a fuel into a cylinder. The designing method includes the steps of: calculating a minimum discharge amount per a unit time in a high-pressure fuel pump driven by the internal combustion engine; and setting an amount of leakage per a unit time in an actuation valve provided with a leakage function provided between the high-pressure fuel pump and a high-pressure pipe supplying the fuel from the high-pressure fuel pump to the fuel injection mechanism to an amount equal to or larger than the minimum discharge amount per a unit time.

According to the present invention, an amount of leakage per a unit time (per one second) in the actuation valve provided with the leakage function is set to an amount equal to or larger than a discharge amount per a unit time (per one second) calculated by using a minimum discharge amount in the high-pressure fuel pump. Accordingly, the discharge amount in the high-pressure fuel pump does not exceed the leakage amount and the fuel pressure does not become too high. Therefore, stop of actuation of the high-pressure fuel pump which results in lowering in the fuel pressure and subsequent resumption of actuation of the same is no longer repeated. Consequently, a method of designing a high-pressure fuel supply apparatus of an internal combustion engine capable of preventing a driver or the like from feeling uncomfortable as a result of irregular actuation sound can be provided.

Preferably, the step of calculating the minimum discharge amount includes the step of calculating the minimum discharge amount per a unit time by using an engine speed of the internal combustion engine.

According to the present invention, the minimum discharge amount per a unit time (per one second) in the high-pressure fuel pump depends on the engine speed of the internal combustion engine. Therefore, with the use of the engine speed at which uncomfortable feeling is felt, generation of irregular actuation sound at that engine speed can be avoided.

Still preferably, the step of calculating the minimum discharge amount includes the step of calculating the minimum discharge amount per a unit time by using an idle speed of the internal combustion engine.

According to the present invention, the minimum discharge amount per a unit time (per one second) in the high-pressure fuel pump depends on the engine speed of the internal combustion engine. Therefore, with the use of the idle speed at which uncomfortable feeling is particularly felt, generation of irregular actuation sound at that idle speed can be avoided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
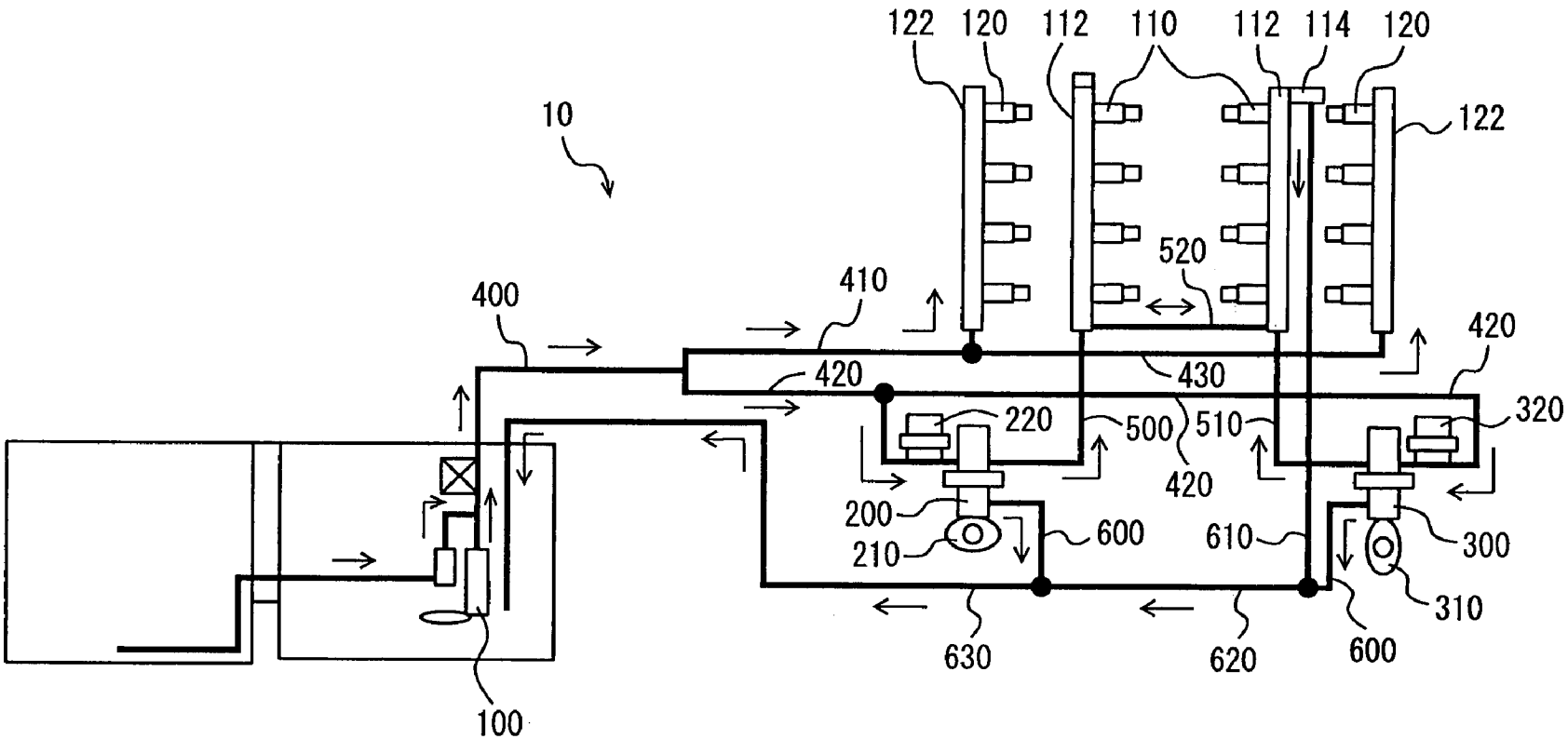
FIG. 1 is an overall schematic view of a fuel supply system of a gasoline engine controlled by a control device according to an embodiment of the present invention.

An embodiment of the present invention will be described hereinafter with reference to the drawings. The same elements have the same reference characters allotted. Their label and function are also identical. Therefore, detailed description thereof will not be repeated.

FIG. 1 shows a fuel supply system 10 of an engine according to an embodiment of the present invention. The engine is a V-type 8-cylinder gasoline engine, and has in-cylinder injectors 110 for injecting the fuel into the respective cylinders, and intake manifold injectors 120 for injecting the fuel into intake manifolds of the respective cylinders. It is noted that the present invention is not applied exclusively to such an engine, but is also applicable to a gasoline engine of another type and a common rail diesel engine. Further, the number of high-pressure fuel pumps is not restricted to two, and the engine is not limited to the V-type 8-cylinder type.

As shown in FIG. 1, this fuel supply system 10 includes a feed pump 100 provided in a fuel tank and for supplying a fuel at a discharge pressure of low pressure (about 400 kPa corresponding to the pressure of a pressure regulator), a first high-pressure fuel pump 200 driven by a first cam 210, a second high-pressure fuel pump 300 driven by a second cam 310 having a discharge phase different from that of first cam 210, a high-pressure delivery pipe 112 provided for each of left and right banks and for supplying a high-pressure fuel to in-cylinder injectors 110, four in-cylinder injectors 110 for each of the left and right banks, provided at the corresponding high-pressure delivery pipe 112, a low-pressure delivery pipe 122 provided for each of the left and right banks and for supplying a fuel to intake manifold injectors 120, and four intake manifold injectors 120 for each of the left and right banks, provided at the corresponding low-pressure delivery pipe 122.

The discharge port of feed pump 100 in the fuel tank is connected to a low-pressure supply pipe 400, which is branched into a first low-pressure delivery connection pipe 410 and a pump supply pipe 420. First low-pressure delivery connection pipe 410 is branched to low-pressure delivery pipe 122 of one of the V-shaped banks, and on the downstream of that branch point, it forms a second low-pressure delivery connection pipe 430, which is connected to low-pressure delivery pipe 122 of the other bank.

Pump supply pipe 420 is connected to intake ports of first and second high-pressure fuel pumps 200 and 300. A first pulsation damper 220 and a second pulsation damper 320 are provided immediately upstream of the intake ports of first and second high-pressure fuel pumps 200 and 300, respectively, so as to reduce fuel pulsation.

The discharge port of first high-pressure fuel pump 200 is connected to a first high-pressure delivery connection pipe 500, which is connected to high-pressure delivery pipe 112 of one of the V-shaped banks. The discharge port of second high-pressure fuel pump 300 is connected to a second high-pressure delivery connection pipe 510, which is connected to high-pressure delivery pipe 112 of the other bank. High-pressure delivery pipe 112 of one bank and high-pressure delivery pipe 112 of the other bank are connected via a high-pressure connection pipe 520.

A relief valve 114 provided at high-pressure delivery pipe 112 is connected via a high-pressure delivery return pipe 610 to a high-pressure fuel pump return pipe 600. The return ports of high-pressure fuel pumps 200 and 300 are connected to high-pressure fuel pump return pipe 600. High-pressure fuel pump return pipe 600 is connected to return pipes 620 and 630, and then connected to the fuel tank.

Figure 2:
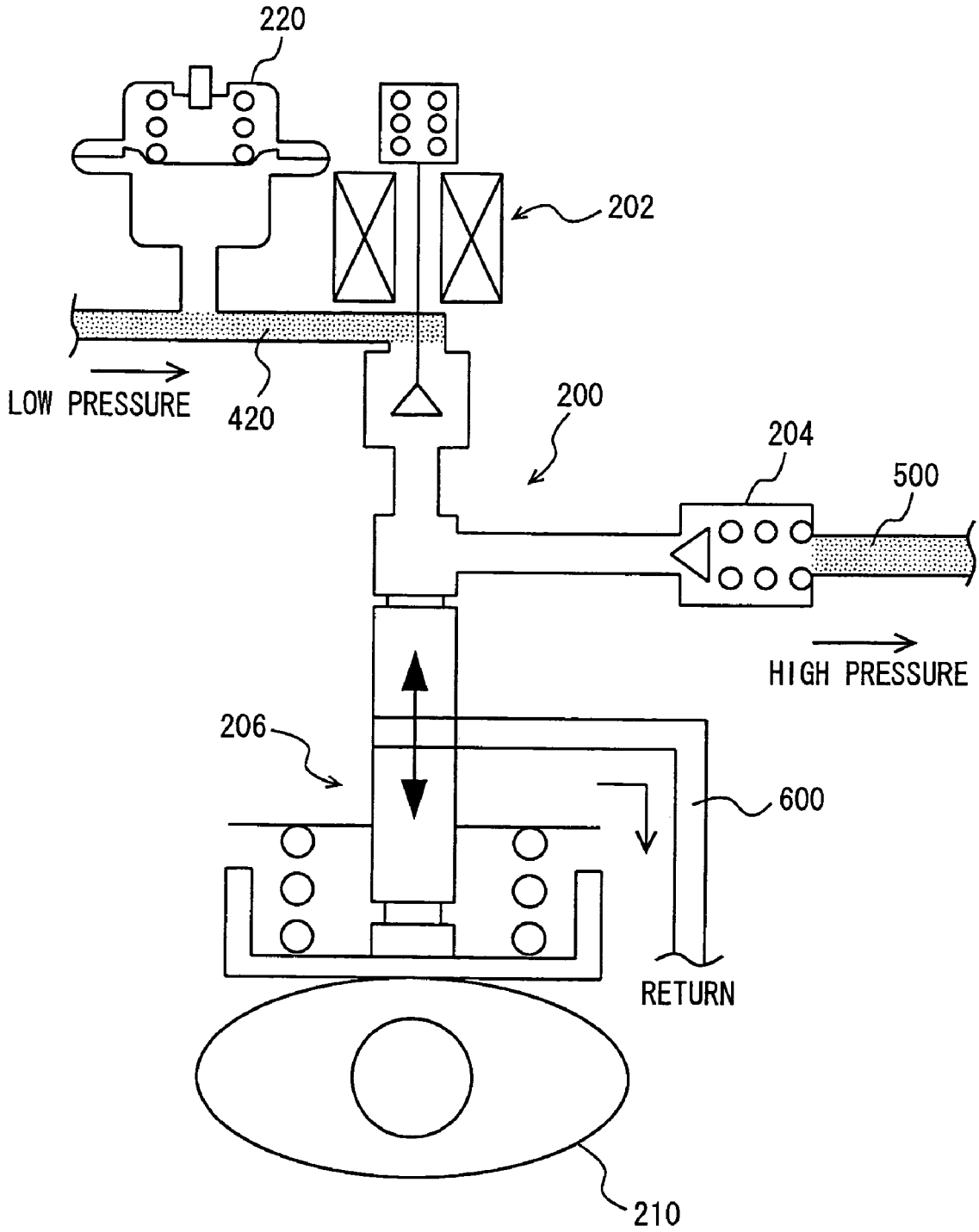
FIG. 2 is a partial enlarged view of FIG. 1.

FIG. 2 is an enlarged view of first high-pressure fuel pump 200 and its surroundings in FIG. 1. Although second high-pressure fuel pump 300 has the similar configuration, they are different in phase of the cams and hence different in phase of the discharge timings, thereby suppressing occurrence of pulsation. First and second high-pressure fuel pumps 200 and 300 may have characteristics similar to or different from each other. In the following explanation, it is assumed that first high-pressure fuel pump 200 has discharge capability that is smaller than discharge capability of second high-pressure fuel pump 300. Such data is stored in a memory of the engine ECU.

High-pressure fuel pump 200 has, as its main components, a pump plunger 206 driven by a cam 210 to slide up and down, an electromagnetic spill valve 202, and a check valve 204 provided with a leakage function.

When pump plunger 206 is moved downward by cam 210 and while electromagnetic spill valve 202 is open, the fuel is introduced (suctioned). When pump plunger 206 is moved upward by cam 210, the timing to close electromagnetic spill valve 202 is changed to control the amount of the fuel discharged from high-pressure fuel pump 200. During the pressurizing stroke in which pump plunger 206 is moved upward, the fuel of a greater amount is discharged as the timing to close electromagnetic spill valve 202 is earlier, whereas the fuel of a fewer amount is discharged as the timing to close the valve is later. The drive duty of electromagnetic spill valve 202 when the greatest amount of fuel is discharged is set to 100%, and the drive duty of electromagnetic spill valve 202 when the smallest amount of fuel is discharged is set to 0%. When the drive duty is 0%, electromagnetic spill valve 202 remains open, in which case, although pump plunger 206 slides up and down as long as first cam 210 continues to rotate (along with rotation of the engine), the fuel is not pressurized because electromagnetic spill valve 202 does not close.

The pressurized fuel presses and opens check valve 204 provided with the leakage function (of the set pressure of about 60 kPa), and the fuel is delivered via first high-pressure delivery connection pipe 500 to high-pressure delivery pipe 112. At this time, the fuel pressure is controlled in a feedback manner by a fuel pressure sensor provided at high-pressure delivery pipe 112. High-pressure delivery pipes 112 at the respective banks are connected via high-pressure connection pipe 520, as described above.

Check valve 204 with the leakage function is a check valve of a normal type but provided with pores that are always open. When the fuel pressure within first high-pressure fuel pump 200 (pump plunger 206) becomes lower than the fuel pressure within first high-pressure delivery connection pipe 500 (for example, when the engine and hence cam 210 stops while electromagnetic spill valve 202 remains open), the high-pressure fuel within first high-pressure delivery connection pipe 500 returns through the pores back to the high-pressure fuel pump 200 side, thereby lowering the fuel pressure within high-pressure delivery connection pipe 500 as well as within high-pressure delivery pipe 112. As such, at the time of stop of the engine, for example, the fuel within high-pressure delivery pipe 112 is not at a high pressure, so that leakage of the fuel from in-cylinder injectors 110 is prevented.

The pores described above are provided by laser material processing. In providing the pores, a check valve leakage amount A [$mm^3$/sec] is calculated in a procedure as below. The pores are processed to realize that check valve leakage amount A [$mm^3$/sec]. Check valve leakage amount A [$mm^3$/sec] is designed to satisfy the following equation:

$$((B \times C/2) \times (N/60)) \leq A \quad (1)$$

where B [$mm^3$/st] represents a minimum discharge amount of the high-pressure fuel pump, N [rpm] represents an engine speed, and C represents the number of cam noses of the pump cam. Here, for example, the idle speed (1000 [rpm]) is substituted for engine speed N [rpm]. By multiplying (B×C/2) representing the minimum discharge amount per one revolution by (N/60), a discharge amount per a unit time (per one second) is calculated. If the minimum discharge amount per a unit time (per one second) is not larger than check valve leakage amount A [$mm^3$/sec], the high-pressure fuel pump should always be actuated. Therefore, if the leakage amount is designed to satisfy check valve leakage amount A [$mm^3$/sec] calculated in Equation (1) above, intermittent actuation of the high-pressure fuel pump can be avoided.

On the other hand, if the discharge amount per a unit time (per one second) is larger than check valve leakage amount A [$mm^3$/sec], the discharge amount is larger than the leakage amount. Then, the fuel pressure within high-pressure delivery pipe 112 is raised and actuation of the high-pressure fuel pump is stopped. Thereafter, the fuel pressure within high-pressure delivery pipe 112 is lowered, and actuation of the high-pressure fuel pump is resumed.

As described above, the fuel supply system according to the present embodiment is designed such that the leakage amount in the check valve provided with the leakage function is equal to or larger than the discharge amount per a unit time (per one second) in the high-pressure fuel pump. Accordingly, the discharge amount in the high-pressure fuel pump does not exceed the leakage amount and the fuel pressure does not become too high. Therefore, stop of actuation of the high-pressure fuel pump which results in lowering in the fuel pressure and subsequent resumption of actuation of the same is no longer repeated. Consequently, uncomfortable feeling felt by a driver or the like as a result of irregular actuation sound can be avoided.

As to engine speed N in Equation (1), if the engine speed is high, actuation sound of the engine, rather than the intermittent actuation sound, stimulates auditory sense. Therefore, it is not necessary to substitute large engine speed N for engine speed N in Equation (1). In particular, if large engine speed N is substituted for the engine speed, check valve leakage amount A [$mm^3$/sec] is set to a large value. In such a case, the discharge amount of the high-pressure fuel pump should be made larger, which is disadvantageous in terms of fuel efficiency or increase in cost of the pump required in improving performance of the pump.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high-pressure fuel supply apparatus of an internal combustion engine having a fuel injection mechanism for injecting a fuel into a cylinder, comprising:

a high-pressure fuel pump driven by the internal combustion engine;

a high-pressure pipe supplying the fuel from said high-pressure fuel pump to said fuel injection mechanism; and an actuation valve provided with a leakage function provided between said high-pressure fuel pump and said high-pressure pipe; wherein an amount of leakage per a unit time in said actuation valve provided with a leakage function is set to an amount equal to or larger than a discharge amount per a unit time calculated by using a minimum discharge amount in said high-pressure fuel pump.

2. The high-pressure fuel supply apparatus of an internal combustion engine according to claim 1, wherein said actuation valve is a check valve.

3. A method of designing a high-pressure fuel supply apparatus of an internal combustion engine having a fuel injection mechanism for injecting a fuel into a cylinder, comprising the steps of:

calculating a minimum discharge amount per a unit time in a high-pressure fuel pump driven by the internal combustion engine; and setting an amount of leakage per a unit time in an actuation valve provided with a leakage function provided between said high-pressure fuel pump and a high-pressure pipe supplying the fuel from said high-pressure fuel pump to said fuel injection mechanism to an amount equal to or larger than said minimum discharge amount per a unit time.

4. The method of designing a high-pressure fuel supply apparatus of an internal combustion engine according to claim 3, wherein said step of calculating said minimum discharge amount includes the step of calculating said minimum discharge amount per a unit time by using an engine speed of the internal combustion engine.

5. The method of designing a high-pressure fuel supply apparatus of an internal combustion engine according to claim 3, wherein said step of calculating said minimum discharge amount includes the step of calculating said minimum discharge amount per a unit time by using an idle speed of the internal combustion engine.

* * * * *